US009312644B2

(12) United States Patent
Kao et al.

(10) Patent No.: US 9,312,644 B2
(45) Date of Patent: Apr. 12, 2016

(54) ELECTRICAL CONNECTOR PLUG

(71) Applicant: Advanced-Connectek Inc., New Taipei (TW)

(72) Inventors: Ya-Fen Kao, New Taipei (TW); Yu-Lun Tsai, New Taipei (TW); Pin-Yuan Hou, New Taipei (TW); Chung-Fu Liao, New Taipei (TW); Wen-Hsien Tsai, New Taipei (TW); Mao-Sheng Chen, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 14/535,464

(22) Filed: Nov. 7, 2014

(65) Prior Publication Data

US 2016/0013595 A1 Jan. 14, 2016

(30) Foreign Application Priority Data

Jul. 14, 2014 (TW) ..... 103124176 A

(51) Int. Cl.
*H01R 9/03* (2006.01)
*H01R 13/6591* (2011.01)
*H01R 24/60* (2011.01)

(52) U.S. Cl.
CPC ..... *H01R 13/6591* (2013.01); *H01R 24/60* (2013.01)

(58) Field of Classification Search
CPC .. H01R 13/6658; H01R 23/688; H01R 12/79; H01R 23/662; H01R 13/65802; H01R 13/658; H01R 23/7073
USPC ..... 439/76.1, 95, 101, 108, 493, 497, 439/607.01, 607.17, 607.41, 607.51, 660
See application file for complete search history.

(56) References Cited

U.S. PATENT DOCUMENTS 7,255,607 B1 * 8/2007 Wu ..... H01R 27/00 439/660
7,410,366 B2 * 8/2008 Wu ..... H01R 13/6658 439/660
7,611,386 B1 * 11/2009 Zhang ..... H01R 12/725 439/660
7,618,293 B2 * 11/2009 Wu ..... H01R 24/62 439/493
7,661,983 B2 * 2/2010 Yang ..... H01R 4/02 439/490
8,070,525 B2 * 12/2011 Hou ..... H01R 13/506 439/660
8,333,616 B2 * 12/2012 Su ..... H01R 13/6581 439/607.41
8,662,933 B2 * 3/2014 Wu ..... H01R 13/6585 439/660
8,961,235 B2 * 2/2015 Little ..... H01R 13/64 439/374
8,986,049 B2 * 3/2015 Kamarauskas .... H01R 13/2442 439/607.41

* cited by examiner

*Primary Examiner* — Thanh Tam Le
(74) *Attorney, Agent, or Firm* — Wang Law Firm, Inc.

(57) ABSTRACT

An electrical connector plug for electrical connection to an electrical connector socket. The electrical connector plug includes: an insulation body extending in a longitudinal direction and including a base portion a mounting portion fixed to the base portion; two rows of resilient conductive terminals mounted in the insulation body and arranged symmetrically in pivotal rotation with respect to the longitudinal direction, each comprising a horizontal segment fixed on the base portion and a bended protrusion contact segment extending from the horizontal segment; an electrical conductive plate mounted on the mounting portion including a front segment and an impedance drop segment, extending from the front segment toward the base portion; and a shielding case mounted on the base portion and electrically connected to the metal housing.

7 Claims, 16 Drawing Sheets

ELECTRICAL CONNECTOR PLUG

FIELD OF THE INVENTION

The present invention relates to an electrical connector plug; in particular, to an electrical connector plug applicable for Universal Serial Bus (USB) connection.

BACKGROUND OF THE INVENTION

In using 3C products (including Computer, Communication and Consumer electronics), it is possible to connect various external devices to the multimedia sockets equipped on 3C products in order to further expand additional or required functions. Such external devices may be, for example, an external hard disk driver, a flash drive, a multimedia audio-video apparatus or a keyboard and the like.

This type of devices, e.g., a flash drive, may be configured with several convenient features supporting hot plug-in and plug-and-play operations, therefore, as a 3C product operates, it is not required to deliberately shut down electrical power to perform insert or unplug actions, catastrophic damages or burnouts in the host device or flash drive can be prevented, and the newly inserted external device can be real-time detected and quickly in service. Hence, USB is now gradually considered as a publicly accepted standard specification in industry. So far, the USB technology has evolved from version 1.0 to 3.0 for many structural improvements. However, as the USB socket is typically built inside the 3C product, once damaged, users may find it is difficult to replace or fix it by themselves. Consequently, in the currently available structure, a structural design of two different outlines on both sides thereof is adopted in order to achieve a fool-proof effect thereby preventing damages to the USB socket due to inappropriate insert/unplug actions.

According to current designs, the electrically conductive terminals in a USB socket comprises an resilient structure, and upon inserting a USB plug therein, these conductive terminals are pressed down by the signal transmission terminals of the USB plug to retract and elastically and tightly contact thereto so as to assure stable electrical connections between the USB socket and the USB plug.

However, signal transmission volumes transferred through USB Type-C continuously and significantly ascend, so frequency of transmission signals needs to be elevated; in addition, due to a greater number of conductive terminals in USB Type-C and space-limited integral perspective size thereof, the complexity and compactness in the arrangement of the conductive terminals inevitably become more challenging. In particular, because of the increase in transmission signal frequency and shortened intervals between the signal transmission terminals, the possibility of crosstalk among such terminals becomes significant, and once such crosstalk issues do occur between neighboring terminals in a connector or even among signal terminals of adjacent connectors, the signal to noise (S/N) ratio during transmission operations may decrease such that neighboring signal transmission terminals start to interfere with each other, thus leading to lowered reliability and stability in use.

Moreover, common computer wireless mice or keyboards typically utilize high frequency Bluetooth signals as a means of transmissions, and connectors in general notebook computers, pad computers or relevant computing devices are mostly configured at adjacent locations, so the aforementioned radio frequency (RF) signal interferences may adversely affect the operation smoothness of the connectors.

Accordingly, the present invention attempts to provide an electrical connector plug which, on one hand, adds an electrical conductive structure at corresponding locations of signal transmission terminals transferring high frequency signals so as to reduce the transmission impedance of the high frequency signal terminals by means of capacitive effect, thus enhancing the signal intensity in high frequency signal transmissions, thereby elevating the S/N ratio of high frequency signals and maintaining good high frequency signal quality; on the other hand, it also provides a layer of protection to prevent the structure of the signal transmission terminals from being easily damaged due to excessive pressure thereupon, such that the stability and smoothness of USB Type-C connector plugs in terms of structural strength or high frequency signal transmissions can be greatly improved.

SUMMARY OF THE INVENTION

An aspect of the present invention is to provide an electrical connector plug, wherein an electrical conductive plate is added onto the USB plug in order to reduce the impedance of the high frequency signal terminals transferring high frequency signals thereby lowering intensity attenuation in transmission signals and improving the S/N ratio.

Another aspect of the present invention is to provide an electrical connector plug, wherein a protection means against electro-magnetic interferences is added onto the front segment in the integrally formed electrical conductive plate in order to eliminate the crosstalk issues.

Yet another aspect of the present invention is to provide an electrical connector plug, wherein the delicate and vulnerable signal transmission terminals are installed on the USB plug side in order to facilitate convenience for replacement once damaged.

To achieve the aspects above, the present invention provides an electrical connector plug for electrical connection to an electrical connector socket, where the electrical connector socket has a metal housing and two sets of terminals mounted within the metal housing, wherein the electrical connector plug comprises: an insulation body extending in a longitudinal direction, including a base portion, as well as a mounting portion fixed to the base portion and extending along the longitudinal direction; two rows of resilient conductive terminals mounted in the insulation body and arranged symmetrically in pivotal rotation with respect to the longitudinal direction, each of the resilient conductive terminals comprising a horizontal segment fixed at least in part on the base portion of the insulation body, and a bended protrusion contact segment extending from the horizontal segment, wherein the horizontal segments are mutually parallel to each other, and the protrusion contact segments are adapted for abutting against and being electrically connected to the terminals of the electrical connector socket, each row of the resilient conductive terminals comprising at least a pair of high frequency signal terminals for high frequency signal transmissions; an electrical conductive plate mounted on the mounting portion, comprising: a front segment remote from the base portion; and at least one impedance drop segment, extending from the front segment toward the base portion and at least partially shielding the high frequency signal terminals, thereby lowering the transmission impedance of the high frequency signal terminals; and a shielding case, mounted on the base portion and electrically connected to the metal housing.

The electrical connector plug disclosed in the present invention is characterized in that the signal transmission terminals are alternatively installed on the USB plug and also provides an electrical conductive plate of metal materials such that, by means of the impedance drop segment, in addition to the original internal impedance, a parallel connection electrical resistance can be further generated in each of the high frequency signal terminals so that the transmission impedance through the high frequency signal terminals can be reduced because of the capacitive effect created between the high frequency signal terminals, thereby lowering the signal transmission attenuations and enhancing the S/N ratio; meanwhile, the high frequency signal terminals are at least partially shielded, thus improving the shielding ability for impeding electro-magnetic noises; furthermore, this also helps the resilient conductive terminals to prevent the losses of elastic restoration force due to excessive pressure applied thereon. As such, product features in the USB Type-C connectors can be structurally improved, greatly enhancing the performance of high frequency signal transmissions and strengthening the durability of the integral structure thereof.

DETAILED DESCRIPTION OF THE ILLUSTRATED EMBODIMENTS

Figure 1:
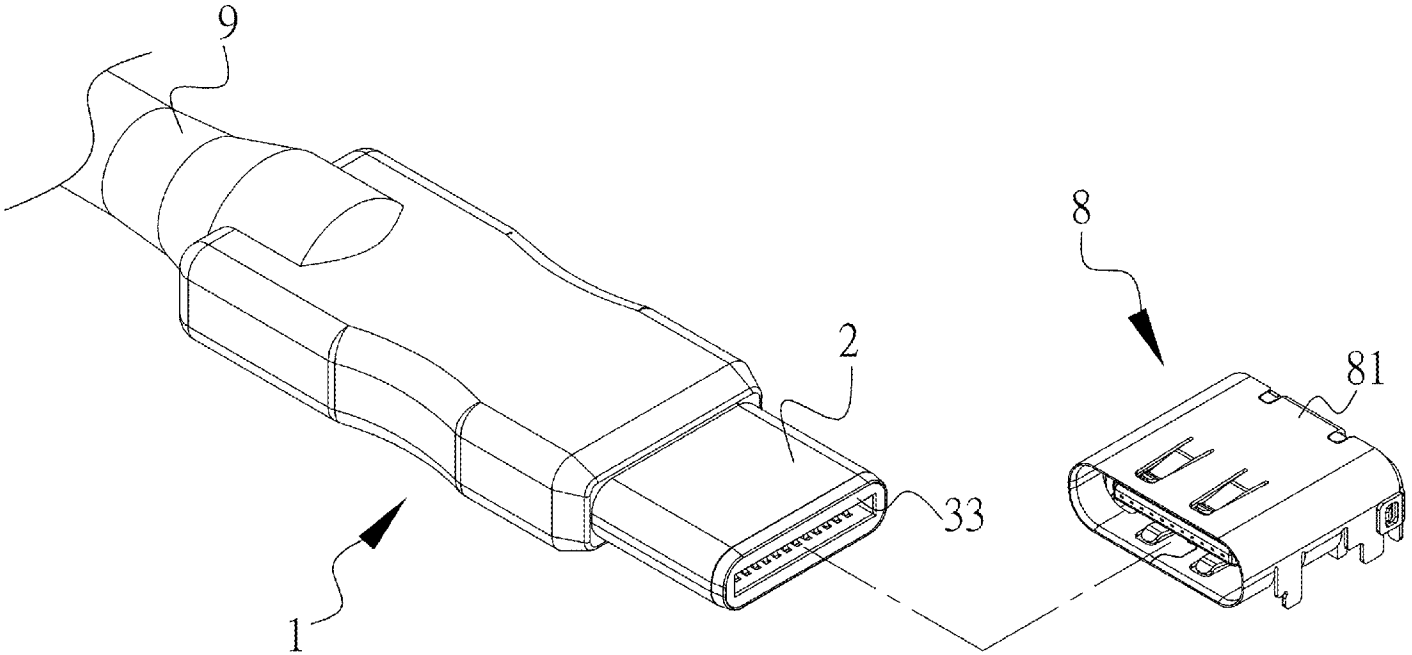
FIG. 1 shows a stereo perspective view of a first preferred embodiment of the USB Type-C electrical connector plug according to the present invention and the insertion correspondence thereof with a socket.

The following description is provided to enable any.

The aforementioned and other technical contents, aspects and effects in relation with the present invention can be clearly appreciated through the detailed descriptions concerning the preferred embodiments of the present invention in conjunction with the appended drawings; moreover, in each embodiment, the same components will be denoted with similar numbers.

A first embodiment of the present invention is exemplified with an electrical connector assembly. Referring to FIGS. 1 to 9, the electrical connector assembly is exemplified with a USB connector assembly, comprising an electrical connector socket 8 exemplified as a USB socket, and an electrical connector plug 1 capable of operating conjunctively with an electrically conductive line 9 and exemplified as a USB plug.

The electrical connector plug 1 includes an insulation body 3. The insulation body 3 has a base portion 31 and a mounting portion 33 fixed to the base portion 31 and extending along a longitudinal direction 32. A shielding case 2 is further mounted on the base portion 31, so that the base portion 31 can be electrically connected to the metal housing 81 of the electrical connector socket 8 by way of the shielding case 2. Upon inserting the electrical connector plug 1 into the electrical connector socket 8, the metal housings of both devices are electrically connected. Also, the electrical connector socket 8 is installed at the housing of a 3C product and conductively connected to grounding of the mother board in the 3C product, so as to create the shielding effect with grounding, such that the signals transferred by each terminal are not vulnerable to interferences caused by external electromagnetic waves between the electrical connector socket 8 and the electrical connector plug 1.

Figure 2:
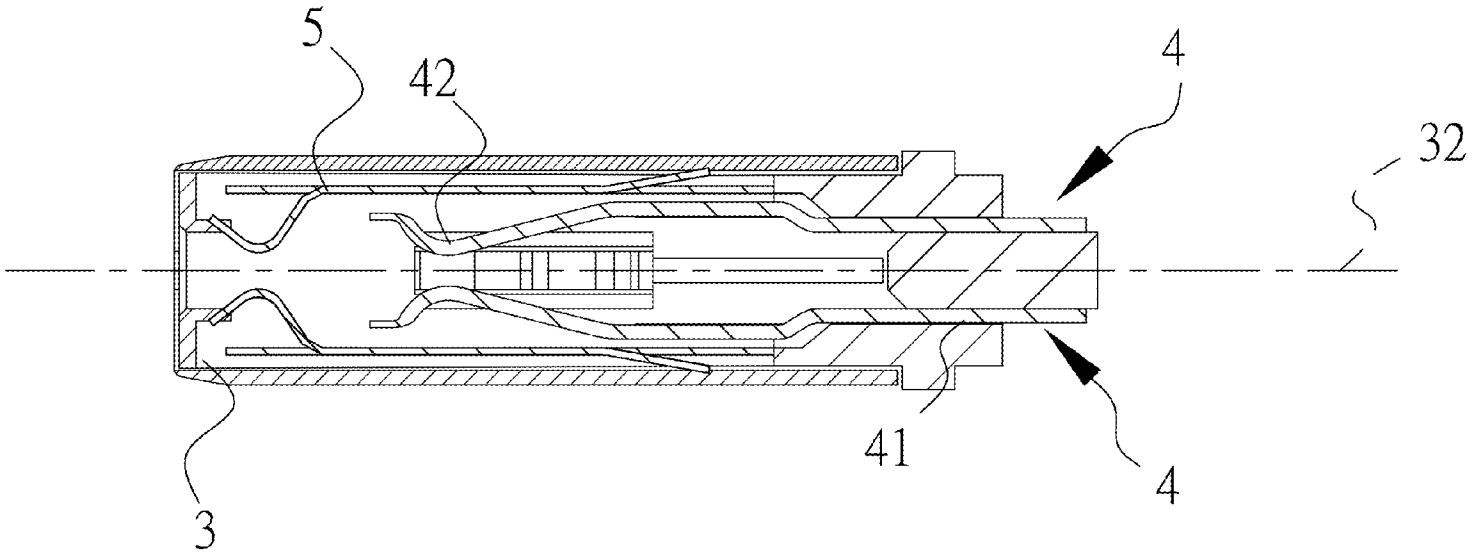
FIG. 2 shows a lateral cross-section view of the electrical connector plug shown in FIG. 1, illustrating the up-low symmetry configuration of the resilient conductive terminals.
Figure 3:
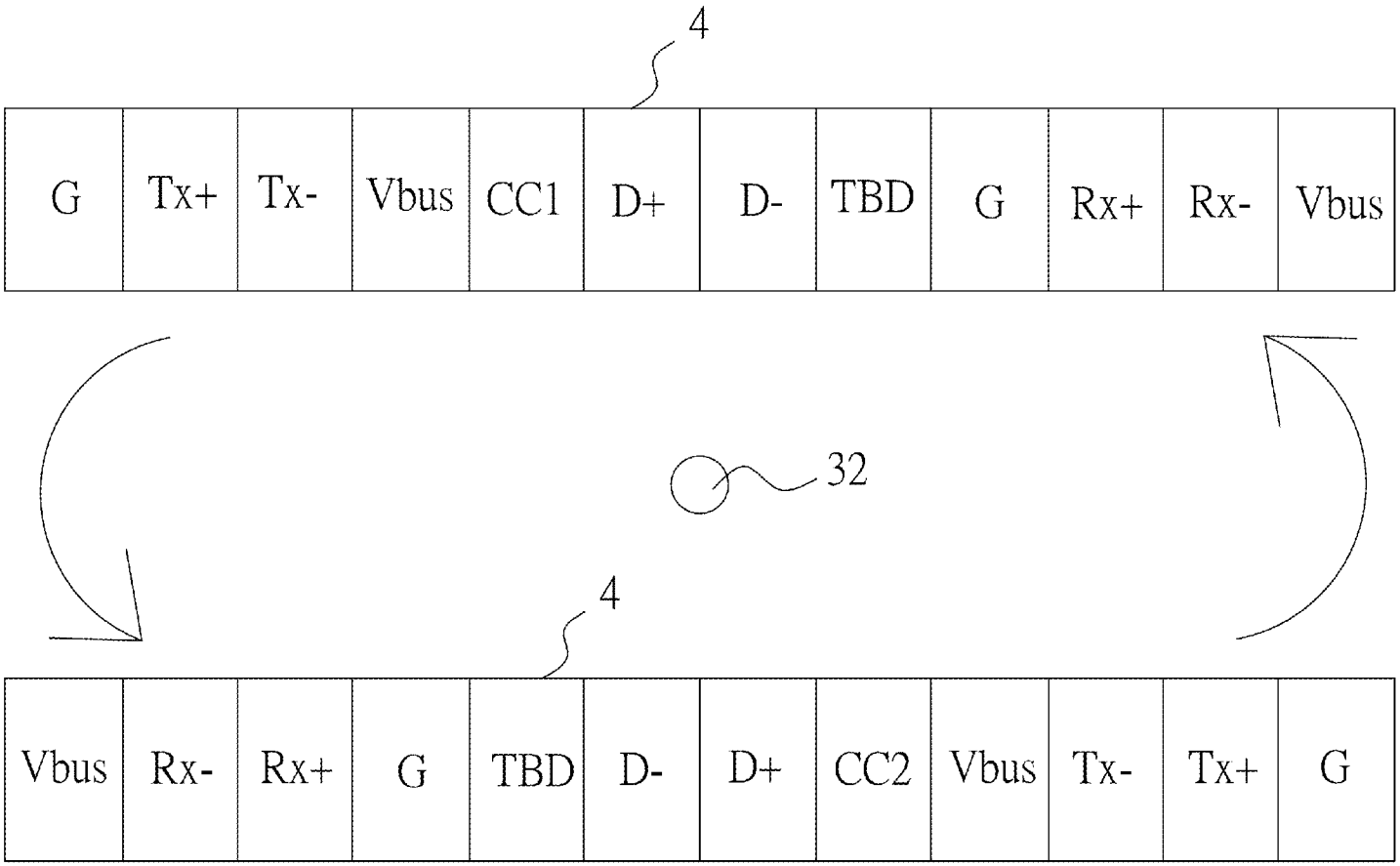
FIG. 3 shows a front view for the terminal arrangement of the electrical connector plug shown in FIG. 1, illustrating the arrangement of the resilient conductive terminals installed symmetrically in pivotal rotation along a longitudinal direction in the connector.

Referring to FIG. 2, two rows of resilient conductive terminals 4 are correspondingly installed on the insulation body 3 with regard to the longitudinal direction 32 as a central axis. As it can be seen from the lateral view, such two rows of fixed resilient conductive terminals 4 are mutually up-low symmetric. In addition, it can be observed from the front view shown in FIG. 3 that any one of the two rows of resilient conductive terminals 4 completely matches the location of the other row of resilient conductive terminals 4 through a rotation of 180 degrees with respect to the longitudinal direction 32 as a pivotal axis. The term "symmetrically in pivotal rotation" or "axially symmetric" is specifically used herein to refer to the above-said status of mutually corresponding configuration and installations on the insulation body 3 for the two rows of resilient conductive terminals 4.

Each of the aforementioned resilient conductive terminals 4 has a horizontal segment 41, and a protrusion contact segment 42 bended extending from the horizontal segment 41. The base portion 31 of the insulation body 3 is further formed with multiple guiding grooves 311 for positioning the respective horizontal segments 41 of the resilient conductive terminals 4, so as to prevent any one of the horizontal segment 41 from erroneously contacting an adjacent one, which may otherwise lead to short circuit issues. 43 At the same time, according to the USB Type-C specifications, each row of resilient conductive terminals 4 individually includes two pairs of terminals for high frequency signal transmissions, i.e., Rx+, Rx− and Tx+, Tx−, which are herein referred to as the high frequency signal terminals 43 for brevity.

As the electrical connector socket 8 similarly needs to have multiple sets of terminals 82 and the intervals between these terminals are very small and not mutually shielded, an electrically conductive plate 5, exemplified herein as a metal plate, is additionally mounted in the electrical connector plug 1, which includes a front segment 51 remote from the base portion 31, and an impedance drop segment 52 extending from the front segment 51 toward the base portion 31 and at least partially shielding the high frequency signal terminals 43.

Figure 4:
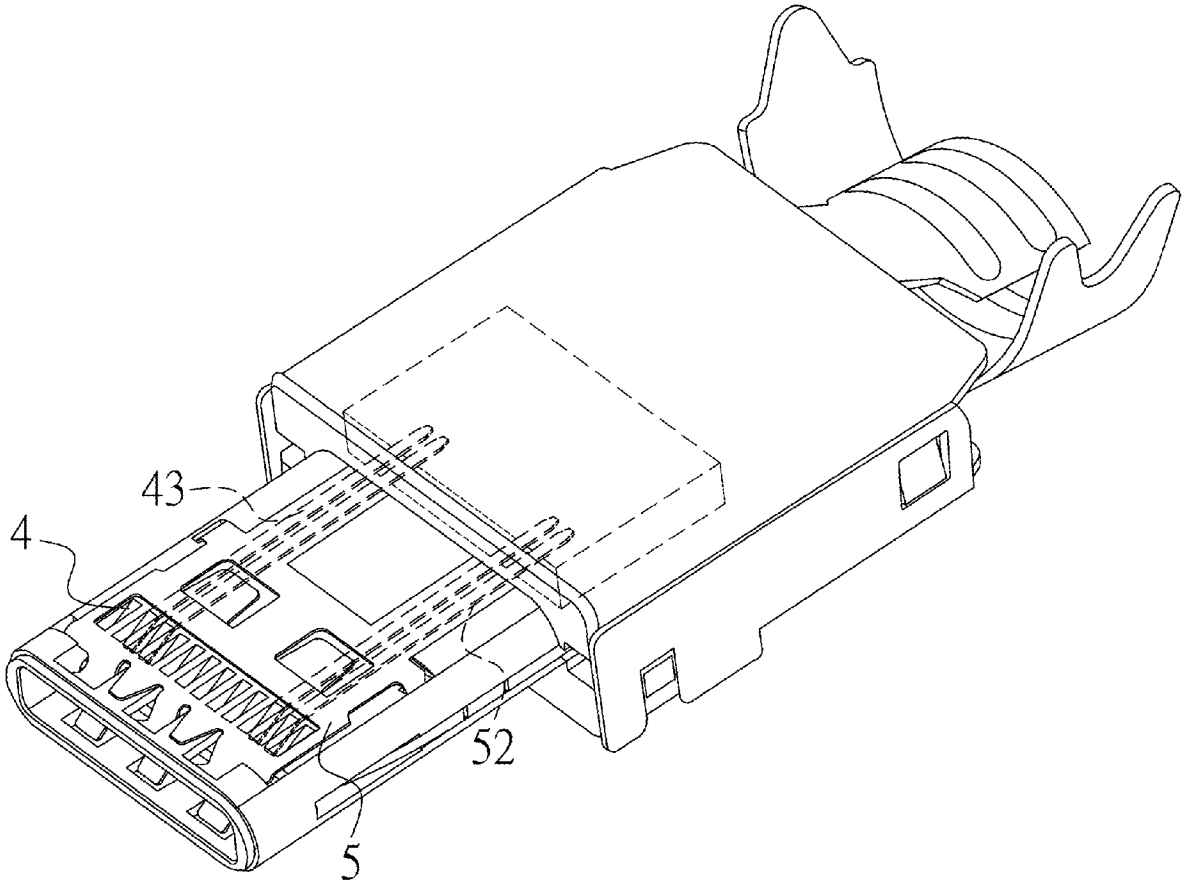
FIG. 4 shows a disassembled stereo view for the structure portions of the electrical connector plug shown in FIG. 1, illustrating a first embodiment of the impedance drop segment with the shielding case removed.
Figure 5:
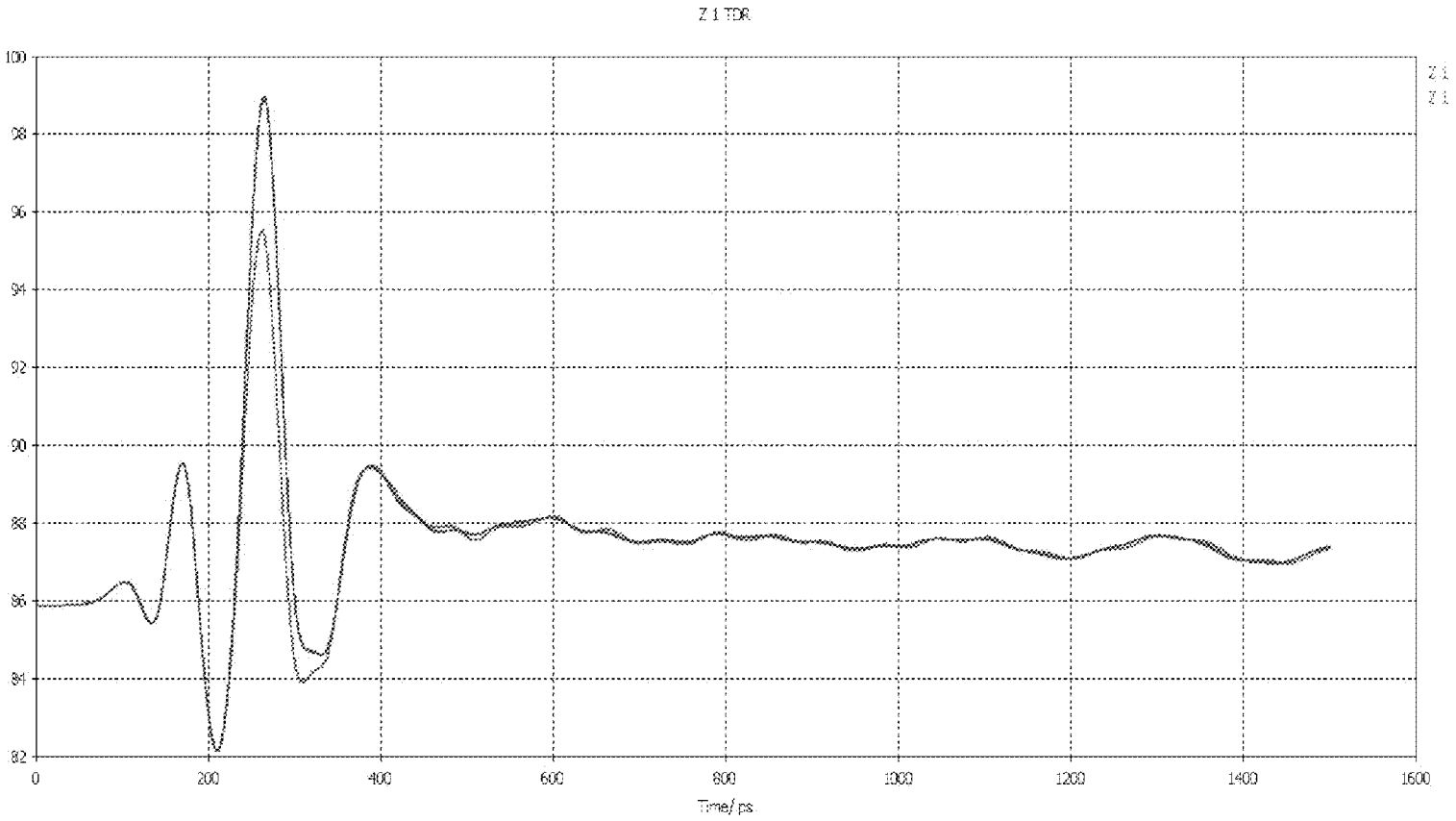
FIG. 5 shows an experiment data diagram for the impedance drop segment shown in FIG. 4.
Figure 6:
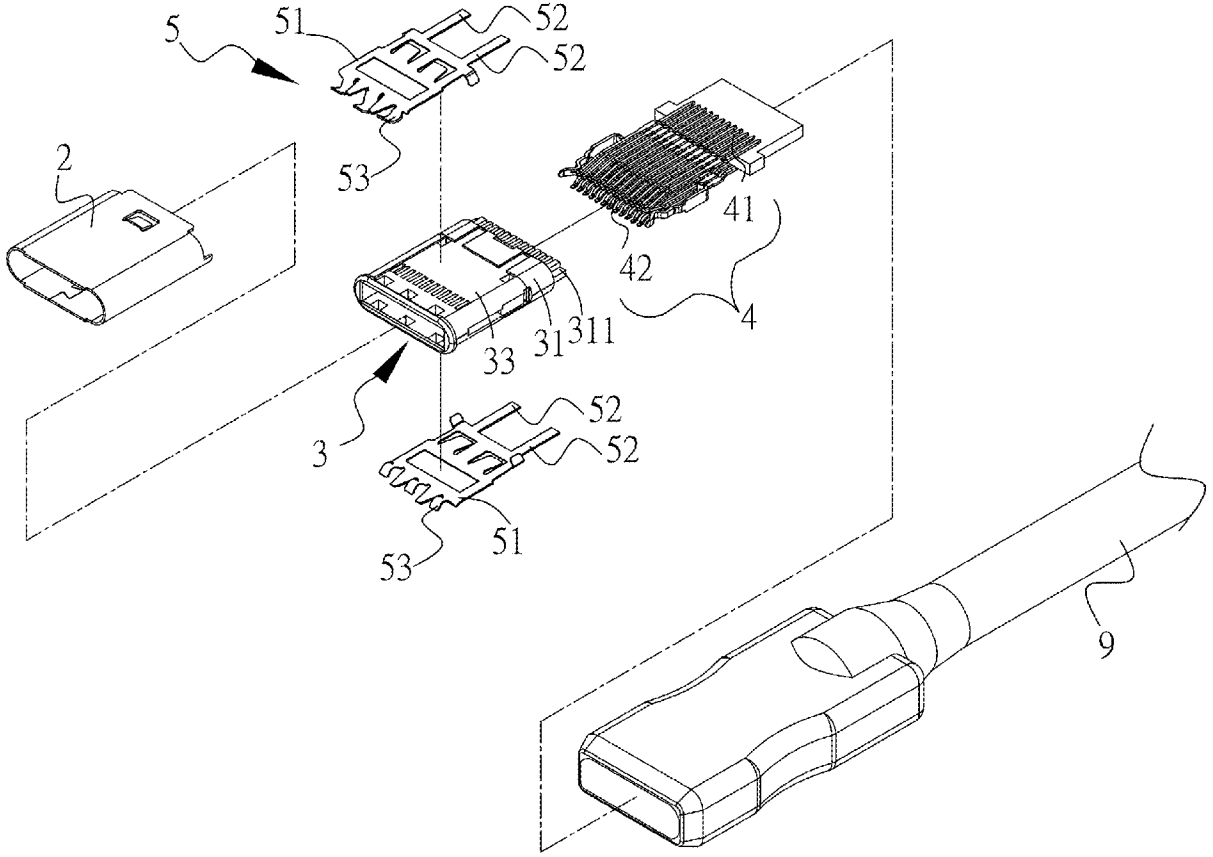
FIG. 6 shows a disassembled stereo view of the electrical connector plug shown in FIG. 1.
Figure 7:
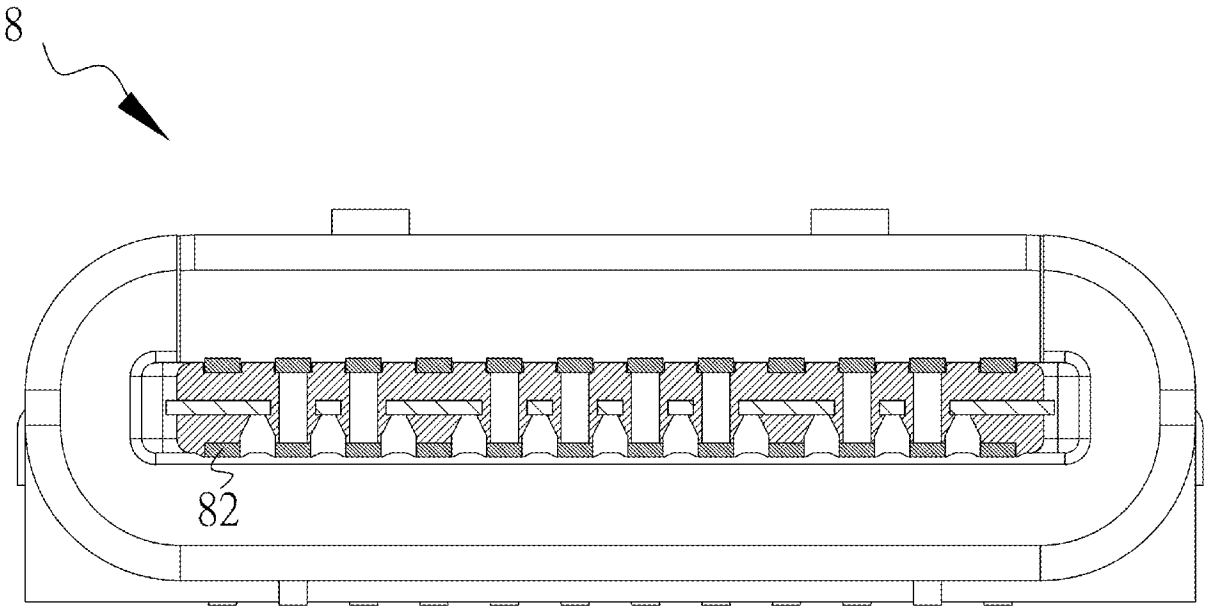
FIG. 7 shows a front view of the electrical connector socket shown in FIG. 1.

Now refer to FIGS. 4 and 5 conjunctively, wherein the impedance drop segment 52 according the present embodiment is capable of shielding the high frequency signal terminals 43 completely such that, when the high frequency signal terminals 43 are transferring alternative current (AC) signals, a capacitive impedance can be created in addition to the internal impedance of the terminals due to the so-called capacitive coupling effect. As a result, the transmission impedance value in high frequency signal transmissions can be reduced by 3 to 4 percent from the original 99 Ohms to approximately 95 Ohms or lower. In this way, the accuracy and reliability of high frequency signal transmissions can be further improved.

Upon conductively connecting the electrical connector plug 1 to the electrical connector socket 8, the terminals 82 of the electrical connector socket 8 may snap into the mounting segment 33 of the insulation body 3 and then abut against and be electrically connected to the resilient conductive terminals 4 of the electrical connector plug 1. In the case where a user applies excessive force thereto, the resilient conductive terminals 4 may be damaged during the user's insert/unplug actions on the electrical connector plug 1. By means of a protection segment 53 extending from the front segment 51 in a direction opposite to the direction that the impedance drop segment 52 extends, the inappropriately applied force can be balanced by the protection segment 53 to prevent the force from consistently pressing against the resilient conductive terminals 4, which otherwise may undesirably lead to elastic fatigue and breakup in the resilient conductive terminals 4. It goes without saying that those skilled ones in the art can easily appreciate that removing the protection segment and having the resilient conductive terminals directly abut against the terminals of the electrical connector socket would not affect the practicality of the present invention.

The front segment can reduce the possibility of electromagnetic interference between different connectors, and the impedance drop segments according the present embodiment are separated into two rows and of a mutually parallel arrangement, with the width of each row exactly covering and shielding one pair of high frequency signal terminals Rx+, Rx− and Tx+, Tx−, respectively. Desirably, the distance between the impedance drop segment and the high frequency signal terminals is smaller than 0.2 mm, preferably up to about 0.18 mm. By means of the capacitive coupling effect, a pattern of parallel plate capacitor can be created between the high frequency signal terminals and the impedance drop segment, formulated as: $\epsilon A/d$, indicating the transmission impedance value is in relation with the distance between the impedance drop segment and the high frequency signal terminals as well as the area of the impedance drop segment. As such, in addition to the original internal impedance, a parallel connection electrical impedance can be further generated in each high frequency signal terminal. As a result, the integral transmission impedance of the high frequency signal terminals can be reduced, thereby optimizing the performance of high frequency signal transmissions. In contrast, the dimension specifications of the electrical connector plug are well defined and regulated, which cannot be arbitrarily altered, and the distance between the shielding case and the high frequency signal terminals is 0.3 mm which is so large that the capacitive effect may become insignificant. Therefore, the impedance drop effect indeed needs to rely on the newly added structure of the present invention to be accomplished.

By means of the aforementioned structural design, the delicate and vulnerable resilient conductive terminals are mounted on the electrical connector plug in order to reduce the damage risk for the socket due to long-term utilization. As the devices connected by the connector plug are mostly peripheral devices, such as a computer mouse or a keyboard, it is apparent that the replacement of peripheral devices would be more convenient, compared with the host machine where the socket resides. Once the resilient conductive terminals are unfortunately damaged during a normal operation, the user can replace them by himself in a handy fashion. Furthermore, a piece of impedance drop segment extends from the front segment of the punch-formed electrically conductive plate in the present embodiment, such that the high frequency signal terminals are partially shielded, thus creating a parallel connection electrical impedance, thereby reducing the integral transmission impedance of the high frequency signal terminals. On the other hand, it is electrically connected to the metal housing of the electrical connector socket through the shielding case of the base portion, thus generating grounding and shielding effects, such that the signals transferred on these terminals between the electrical connector socket and the electrical connector plug would not be interfered by external electro-magnetic waves thereby facilitating convenience in use. Of course, those skilled ones in the art can appreciate that the formation for the electrically conductive plate can be also done by die casting processes, and the implementation of the present invention is not affected.

Figure 8:
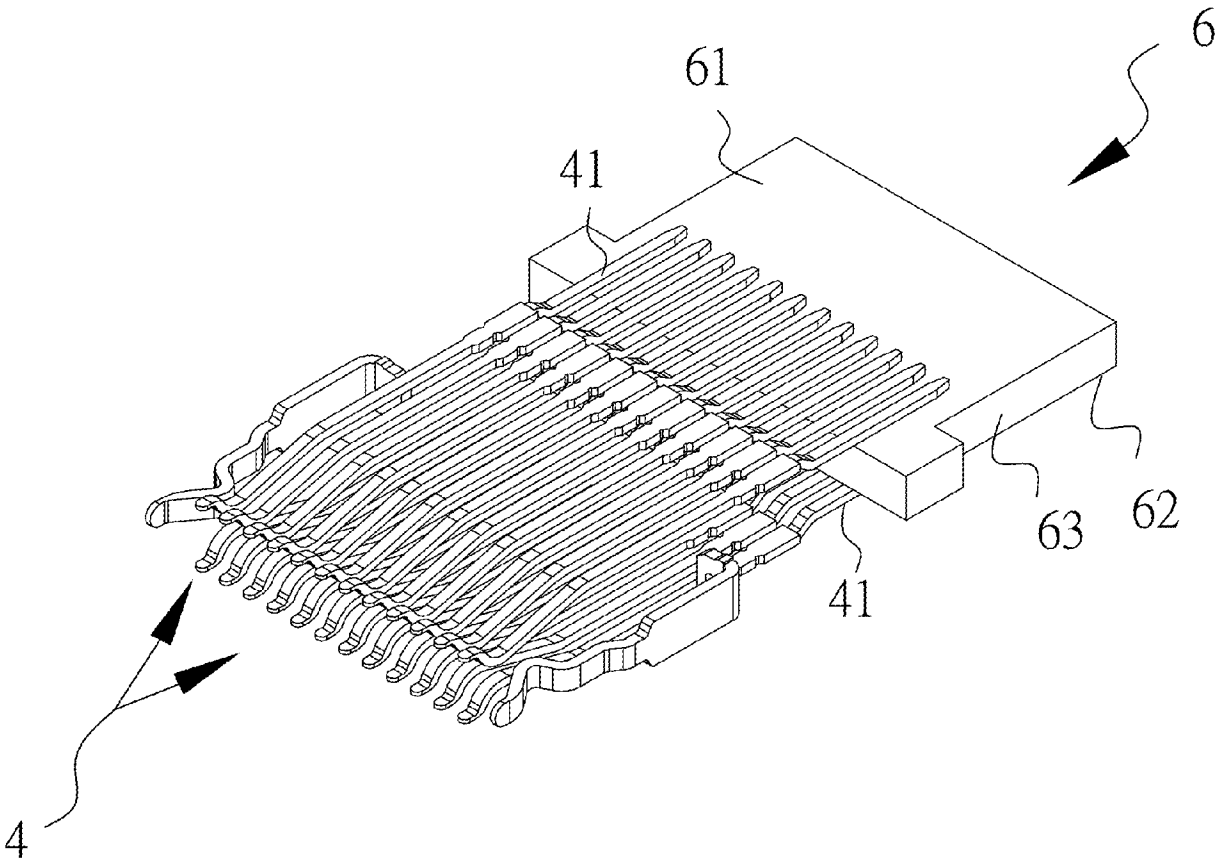
FIG. 8 shows an enlarged stereo view for the combination of the resilient conductive terminals of FIG. 6 and a circuit board.
Figure 9:
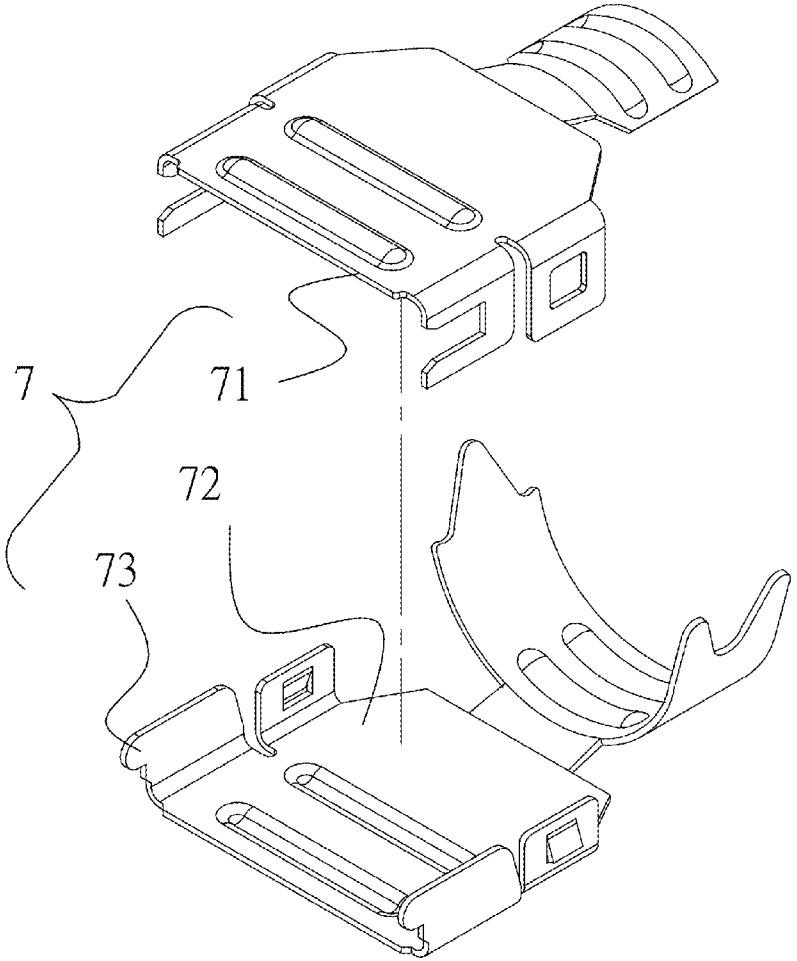
FIG. 9 shows a view for the combination of the upper and lower housings in the metal electrically conductive case of the embodiment shown in FIG. 1, illustrating welding points are retained for the circuit board.

Referring now to FIGS. 8 and 9, the electrical connector plug according to the present embodiment further comprises a circuit board 6 which has a front side 61, a rear side 62 and two lateral sides 63 connecting the front side 61 to the rear side 62. Small parts of the horizontal segments 41 in two rows of resilient conductive terminals 4 are laser welded onto the front side 61 and the rear side 62 and arranged symmetrically in pivotal rotation, such that the two rows of resilient conductive terminals 4 are arranged symmetric in pivotal rotation. The respective horizontal segments 41 are secured in position, thereby preventing the horizontal segments 41 from inappropriately contacting each other, thus eliminating short circuit issues.

The metal electrically conductive case 7 may further comprise an upper housing 71 and a lower housing 72, in which the upper housing 71 and the lower housing 72 are formed with two welding points 73, respectively. These welding points 73 correspond to the two lateral sides 63 of the circuit board 6, so that the upper housing 71, the lower housing 72 and the circuit board 6 can be welded together, thereby strengthening the integral durability of the electrical connector plug 1. In the case where an operator accidentally drops the electrical connector plug 1 on the ground, the impact force hitting on the ground may not cause the structure of the metal electrically conductive case 7 to come loose or break up.

Figure 10:
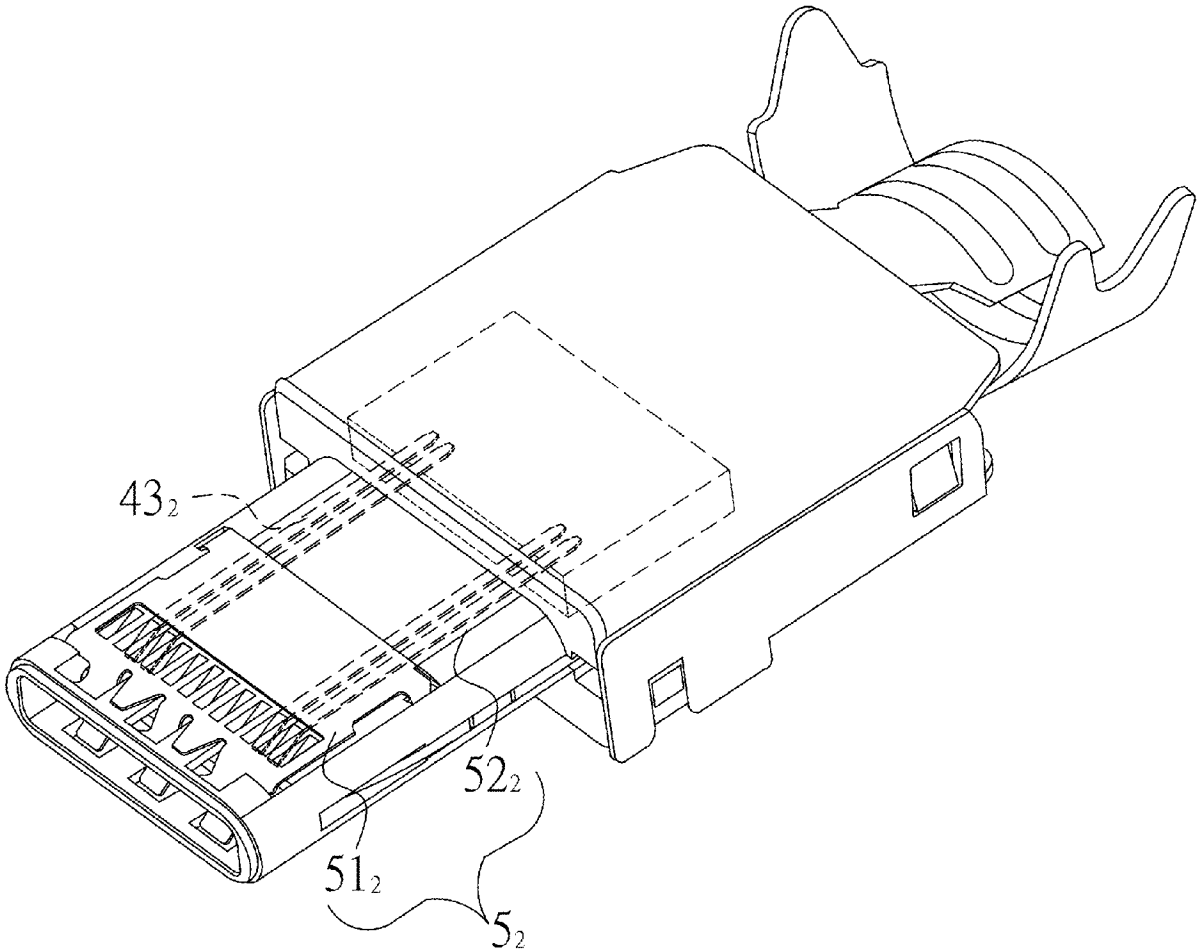
FIG. 10 shows a disassembled stereo view for the structure portions of a second preferred embodiment of the electrical connector plug according to the present invention, illustrating the structure of the impedance drop segment with the shielding case removed.
Figure 11:
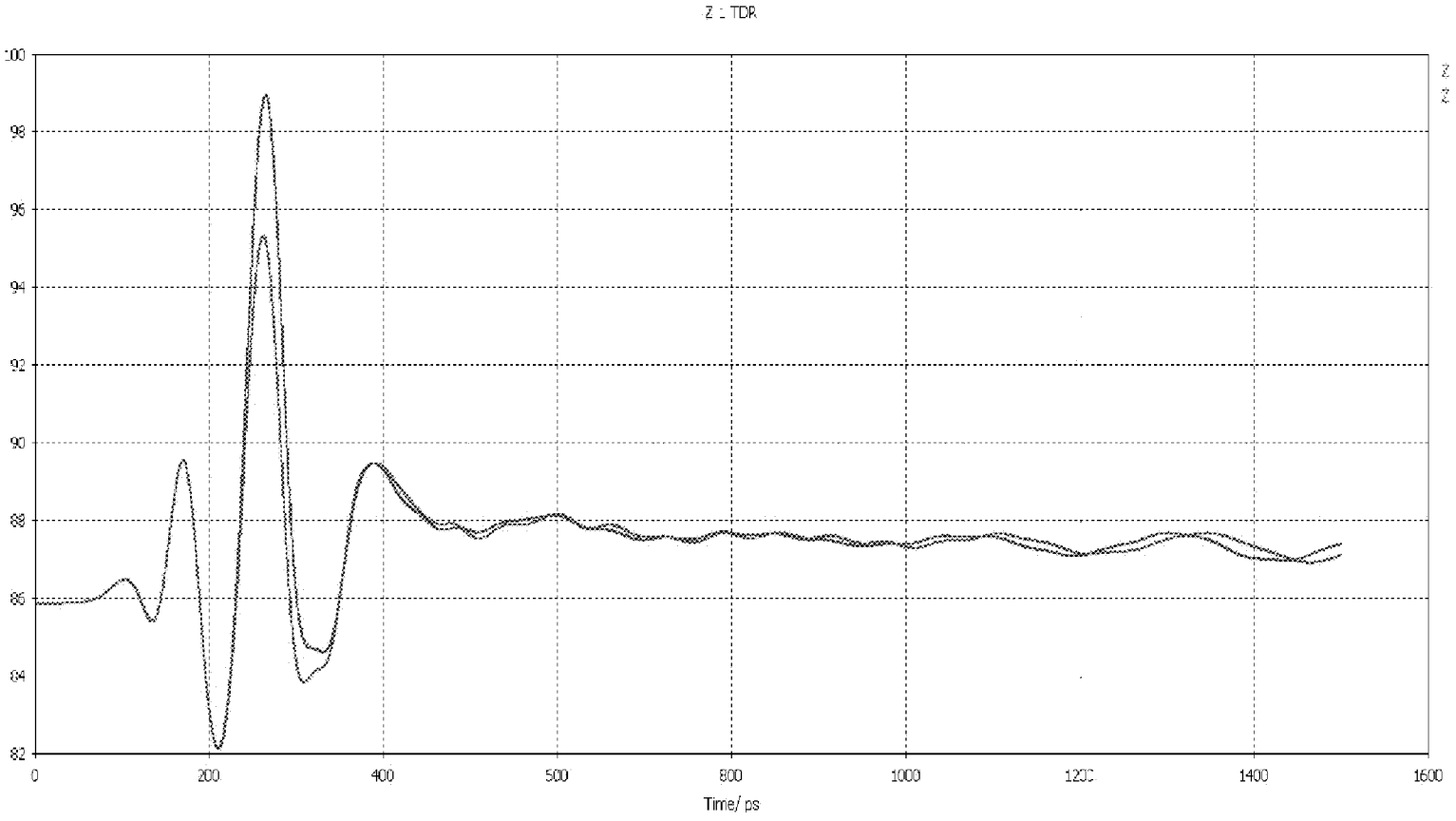
FIG. 11 shows an experiment data diagram for the impedance drop segment shown in FIG. 10.

A second preferred embodiment according to the invention, as well as the experimental data thereof, are shown in FIGS. 10 and 11. As illustrated, the present embodiment is generally identical to the embodiment described above, but it can be clearly seen that the front segment $\mathbf{51}_2$ in the present embodiment is not punched through; rather, it is kept as a complete metal plate. Furthermore, in addition to shielding the high frequency signal terminals $\mathbf{43}_2$, the impedance drop segments $\mathbf{52}_2$ also extend to cover the upper and lower sides of the respective terminals between the two sets of high frequency signal terminals $\mathbf{43}_2$, so that the transmission impedance value of the high frequency signal terminals $\mathbf{43}_2$ can exhibit substantially the same reduction result as what achieved in the embodiment described above. Certainly, since the electrically conductive plate $\mathbf{5}_2$ according to the present embodiment is not perforated, the mould shaping processes can be simplified and the electrically conductive plate $\mathbf{5}_2$ can be a flat metal plate in practice.

Figure 12:
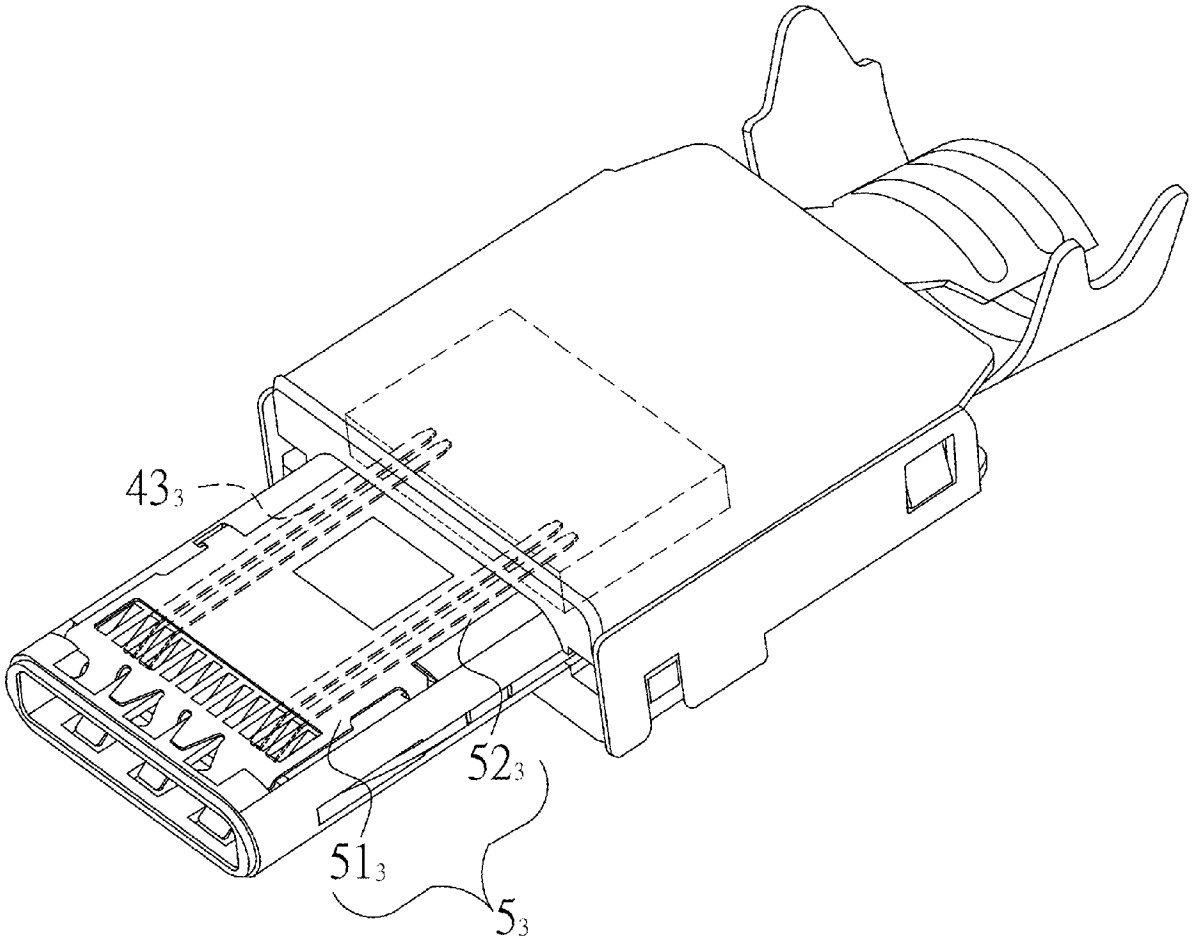
FIG. 12 shows a disassembled stereo view for the structure portions of a third preferred embodiment of the electrical connector plug according to the present invention, illustrating the structure of the impedance drop segment with the shielding case removed.
Figure 13:
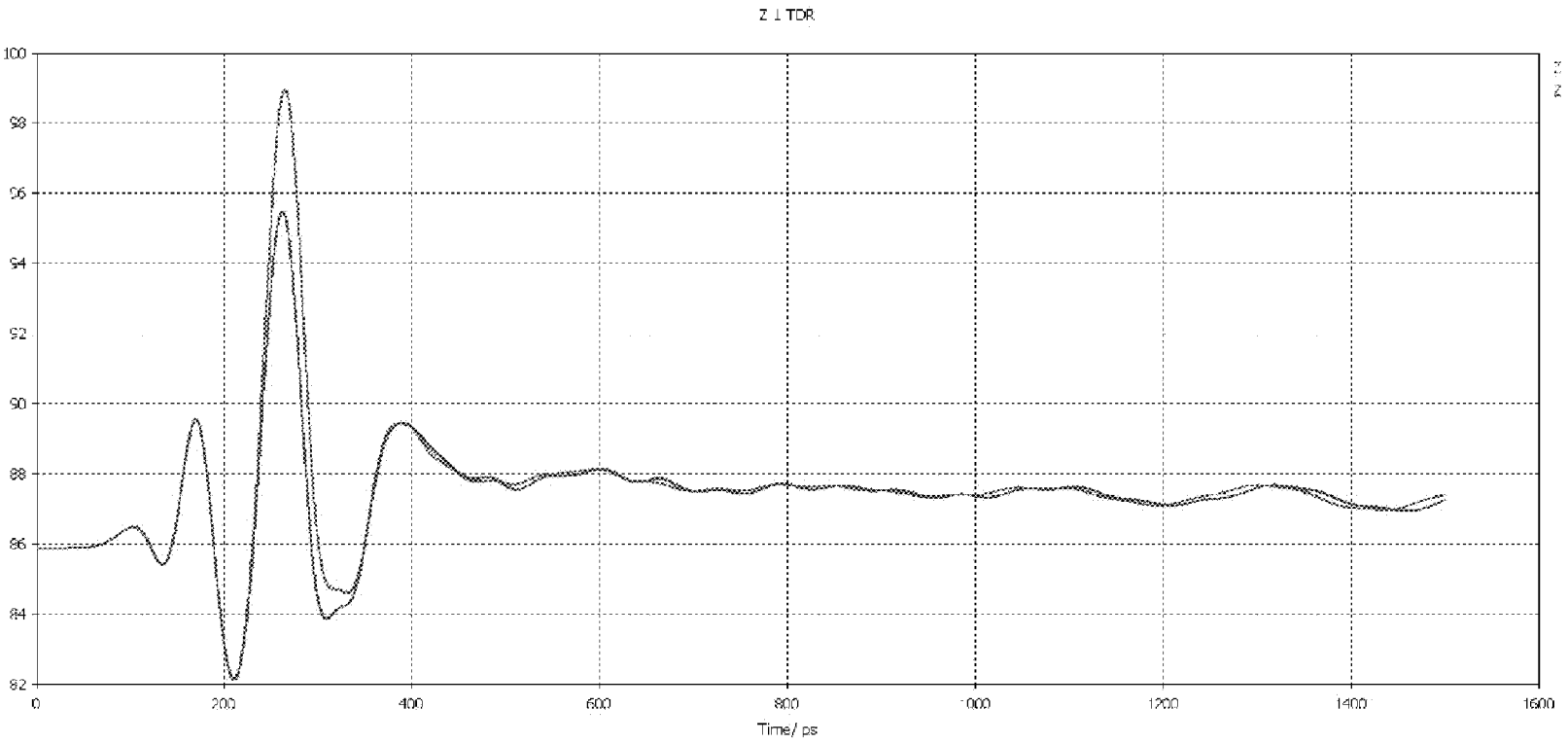
FIG. 13 shows an experiment data diagram for the impedance drop segment shown in FIG. 12.

A third preferred embodiment according to the present invention, as well as the experimental data thereof, are shown in FIGS. 12 and 13. According to the present embodiment, the electrically conductive plate $\mathbf{5}_3$ shown in the first embodiment is modified, where a connection segment (not denoted) connected to the impedance drop segment $\mathbf{52}_3$ is added at the rear of the impedance drop segment $\mathbf{52}_3$ opposite to the front segment $\mathbf{51}_3$. In this way, not only the transmission impedance value in the high frequency signal terminals $\mathbf{43}_3$ exhibits the same drop extent as the second embodiment, but the structural stability of the impedance drop segment $\mathbf{52}_3$ can be better secured than the first embodiment, and less materials are required than the second embodiment as well.

Figure 14:
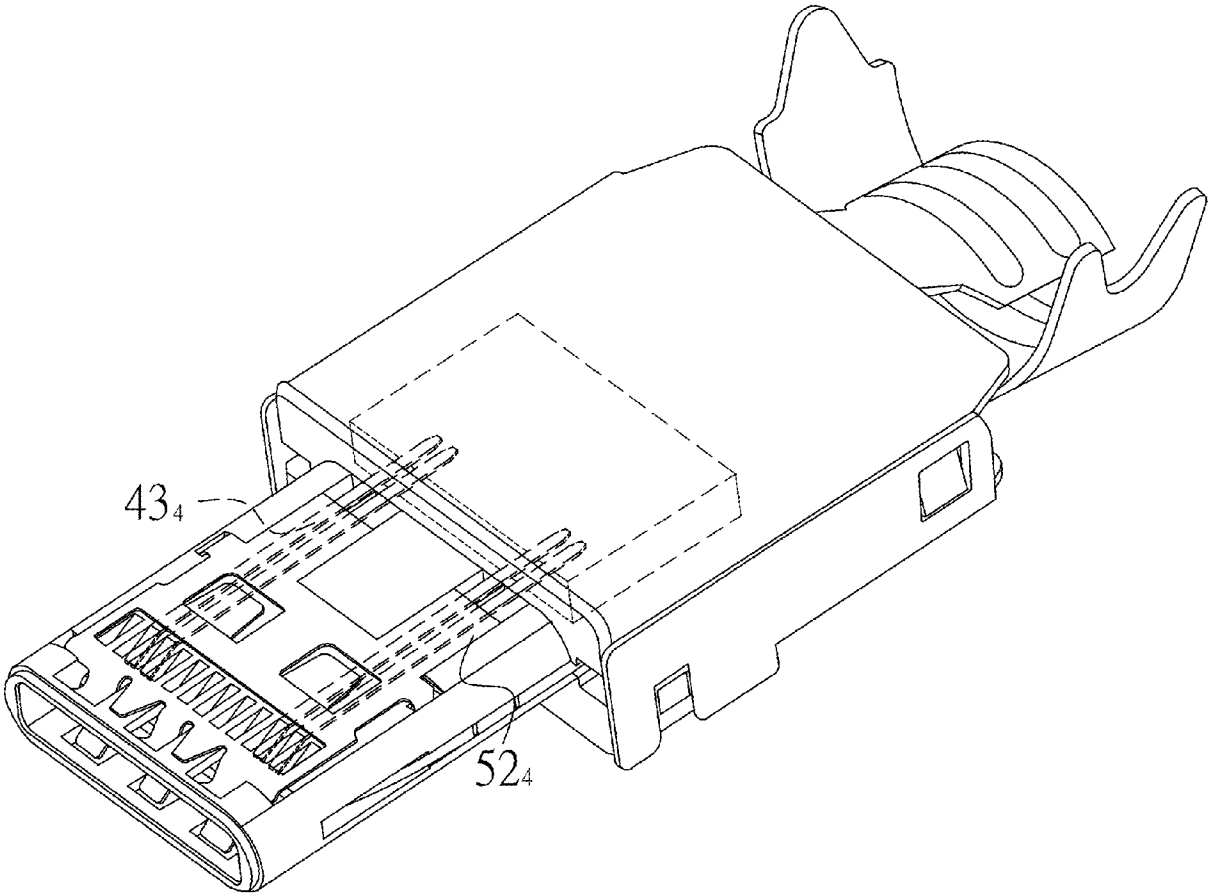
FIG. 14 shows a disassembled stereo view for the structure portions of a fourth preferred embodiment of the electrical connector plug according to the present invention, illustrating the structure of the impedance drop segment with the shielding case removed.
Figure 15:
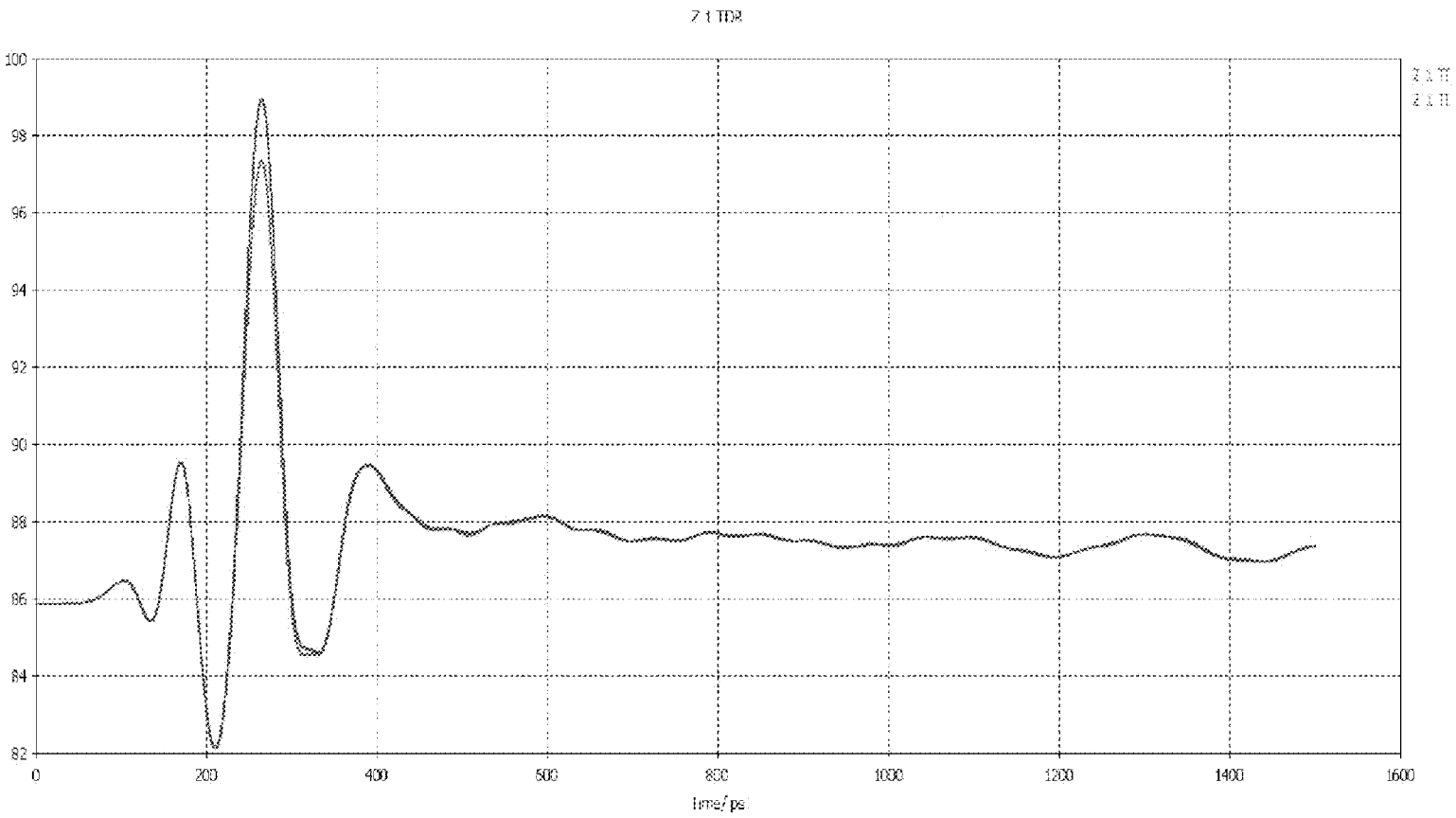
FIG. 15 shows an experiment data diagram for the impedance drop segment shown in FIG. 14.

A fourth embodiment according to the present invention is shown in FIGS. 14 and 15. Herein the structure of the impedance drop segment $\mathbf{52}_4$ is simplified and a part of the high frequency signal terminals $\mathbf{43}_4$ is exposed. By virtue of the impedance drop segment $\mathbf{52}_4$ according to the present embodiment, although it can only provide an impedance of 97 Ohms which is still better than conventional values, this approach is advantageous in material savings and still able to effectively accomplish the technical characteristics of the present invention.

Figure 16:
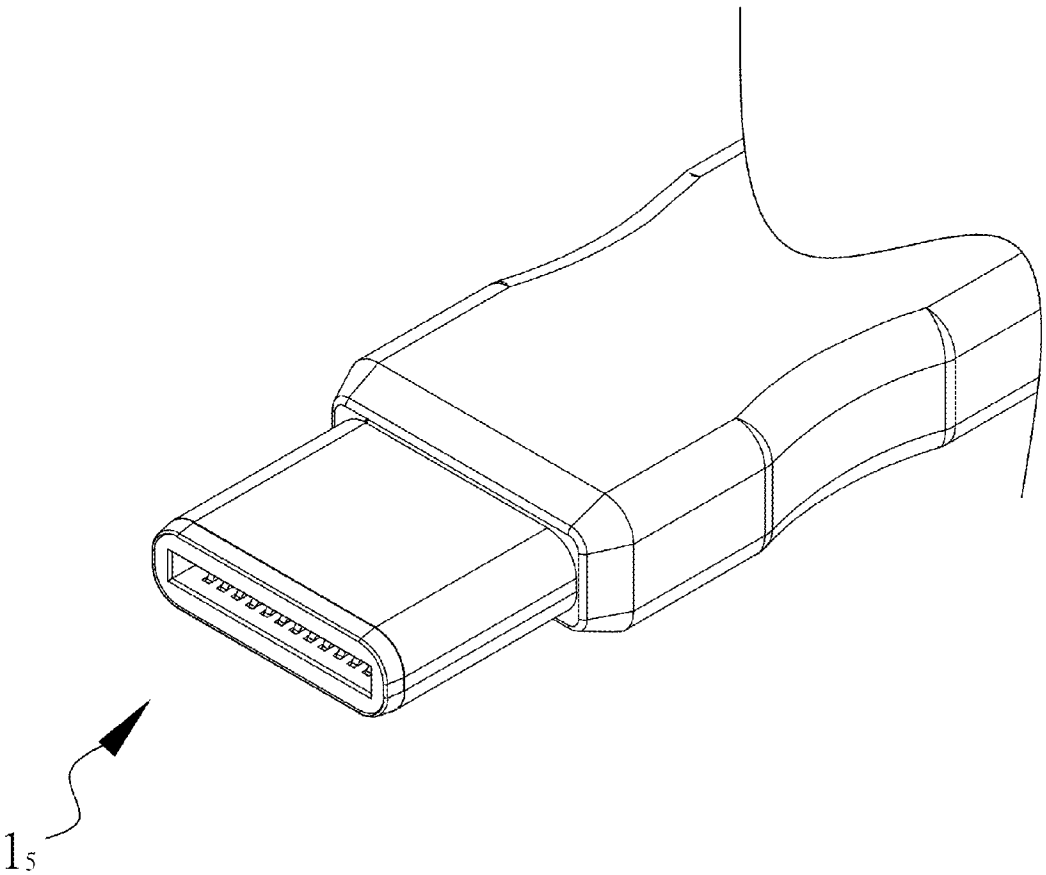
FIG. 16 shows a fifth preferred embodiment of the electrical connector plug according to the present invention, illustrating relevant components for combination with the electrical connector plug thereby constituting a common USB flash drive.

Next, a fifth embodiment of the present invention is shown in FIG. 16. The skilled person in the art can easily conceive that the conductive lines in the first embodiment can be removed, the electrical connector plug $\mathbf{1}_5$ can be encapsulated with a plastic housing (not denoted) thus simply exposing the shielding case (not denoted), and then the resilient conductive terminals (not denoted) in the plastic housing are similarly laser welded onto the circuit board (not denoted), thereby constituting a common flash drive and further enhancing the flexibility in use of the electrical connector plug.

The electrical connector plug according to the present invention can effectively reduce the transmission impedance in the high frequency electrically conductive terminal pairs by means of the impedance drop segments, which are capable of at least partially shielding the high frequency electrically conductive terminal pairs. This arrangement enables the enhancement of S/N ratio in the high frequency signal transmission and the effective isolation of external interferences to the USB terminals thereby further ameliorating the signal transmission performance. Moreover, the resilient conductive terminals are installed inside the insulation body of the electrical connector plug, which reduces abrasions to the socket part and improves smoothness in use of the USB Type-C, thus achieving all objectives of the present invention.

It should be noticed that, however, the illustrations set forth as above simply describe the preferred embodiments of the present invention which are not to be construed as restrictions for the scope of the present invention; contrarily, all effectively equivalent changes and modifications conveniently made in accordance with the claims and specifications disclosed in the present invention are deemed to be encompassed by the scope of the present invention delineated in the following claims.

What is claimed is:

1. An electrical connector plug for electrical connection to an electrical connector socket, where the electrical connector socket has a metal housing and two sets of terminals mounted within the metal housing, wherein the electrical connector plug comprises:

an insulation body extending in a longitudinal direction, including a base portion, as well as a mounting portion fixed to the base portion and extending along the longitudinal direction;

two rows of resilient conductive terminals mounted in the insulation body and arranged symmetrically in pivotal rotation with respect to the longitudinal direction, each of the resilient conductive terminals comprising a horizontal segment fixed at least in part on the base portion of the insulation body, and a bended protrusion contact segment extending from the horizontal segment, wherein the horizontal segments are mutually parallel to each other, and the protrusion contact segments are adapted for abutting against and being electrically connected to the terminals of the electrical connector socket, each row of the resilient conductive terminals comprising at least a pair of high frequency signal terminals for high frequency signal transmissions;

an electrical conductive plate mounted on the mounting portion, comprising:

a front segment remote from the base portion; and at least one impedance drop segment, extending from the front segment toward the base portion and at least partially shielding the high frequency signal terminals, thereby lowering the transmission impedance of the high frequency signal terminals; and a shielding case, mounted on the base portion and electrically connected to the metal housing.

2. The electrical connector plug according to claim 1, wherein each row of the resilient conductive terminals comprises two pairs of the high frequency signal terminals, and the impedance drop segments comprise two metal plates extending from the front segment to the base portion.

3. The electrical connector plug according to claim 2, wherein each of the metal plates has a width that covers one pair of the high frequency signal terminals.

4. The electrical connector plug according to claim 1, further comprising a circuit board for being electrically connected to the horizontal segments of the resilient conductive terminals, said circuit board comprising a front side, a rear side and two lateral sides connecting the front side to the rear side.

5. The electrical connector plug according to claim 4, further comprising a metal conductive case, wherein the metal conductive case comprises an upper housing and a lower housing, and the upper and the lower housings each has two welding points corresponding to the two lateral sides of the circuit board, so that the upper housing, the lower housing and the circuit board can be welded conjunctively.

6. The electrical connector plug according to claim 1, wherein the base portion of the insulation body is formed with multiple guiding grooves for positioning the horizontal segments of the resilient conductive terminals.

7. The electrical connector plug according to claim 1, wherein the electrical conductive plate is formed by press molding.

* * * * *